United States Patent [19]

Morishita et al.

[11] Patent Number: 4,806,421

[45] Date of Patent: Feb. 21, 1989

[54] THERMAL TRANSFER RECORDING SHEET

[75] Inventors: Sadao Morishita, Ushiku; Toshihiko Matsushita, Tokyo; Takeo Sugiyama, Takasago, all of Japan

[73] Assignee: Mitsubishi Paper Mills, Ltd., Tokyo, Japan

[21] Appl. No.: 59,776

[22] Filed: Jun. 8, 1987

[30] Foreign Application Priority Data

Jun. 9, 1986 [JP] Japan ..... 61-134478

[51] Int. Cl.[4] ..... B41M 5/26

[52] U.S. Cl. ..... 428/324; 428/206; 428/328; 428/329; 428/331

[58] Field of Search ..... 428/195, 207, 484, 480, 428/488.1, 488.4, 913, 914, 206, 323, 324, 328, 329, 331

[56] References Cited

U.S. PATENT DOCUMENTS 4,682,191 7/1987 Tamagawa et al. ..... 428/207

FOREIGN PATENT DOCUMENTS 138483 4/1985 European Pat. Off. ..... 428/488.4

9823 1/1980 Japan ..... 428/488.4

*Primary Examiner*—George F. Lesmes

*Assistant Examiner*—P. R. Schwartz

*Attorney, Agent, or Firm*—Cushman, Darby & Cushman

[57] ABSTRACT

A thermal transfer recording sheet comprising a support containing plate-like or lamellar inorganic fine particles therein and a thermal transfer coloring ink layer formed on one side of the support, and if required a heat resistant layer formed on another side of the support, hardly provides wear of a thermal head surface while maintaining good take-up characteristics of synthetic resin film used as a support.

7 Claims, No Drawings

THERMAL TRANSFER RECORDING SHEET

BACKGROUND OF THE INVENTION

This invention relates to a thermal transfer recording sheet. More particularly, it relates to a thermal transfer recording sheet containing inorganic fine particles having a plate-like or lamellar structure in a support so as to lessen wear of a thermal head.

Recently, there have been developed thermal transfer recording materials which form transferred images on plain paper, using thermal printers, thermal facsimiles, and the like. This thermal tranffer recording method is noticed because the maintenance of apparatus is easy due to its simple structure, the price and maintenance cost of apparatus are low, clear and durable recording is possible with low energy, and colored recording is possible with relative ease by using multi-color ink sheets.

According to the thermal transfer recording method, the recording is accomplished by placing an image receiving sheet on a hot-melt or heat sublimable coloring ink layer coated on a support of a thermal transfer recording sheet, heating selectively the hot-melt or heat sublimable ink layer by a thermal head depending on electric signals from the non-coated side of the thermal transfer recording sheet so as to transfer an image on the image receiving sheet, and separating the image receiving sheet from the thermal transfer recording sheet. At present, single color (black) recording is practically used in word processors, facsimiles, printers, and the like. Further, multi-color recording is to be used practically in color copies and printers for CAD (Computer Aided Design).

As the support of these thermal transfer recording sheets used for such recording, there are used condenser paper with 10 to 13 μm thick and synthetic resin films with 3 to 15 μm thick. Among them, a polyester film is preferably used considering strength, heat resistance and a cost. The surface of the thermal transfer recording sheet to be contacted with a thermal head can be coated with a heat resistance improving agent with a thickness of 0.1 to several microns in order to withstand the heat of the thermal head. In the case of using a synthetic resin film such as a polyester film as the support, inorganic particles of silicon oxide, calcium carbonate or aluminum oxide are added to the synthetic resin film as a slipping agent in order to improve take-up characteristics of the synthetic resin film after film forming. But in such a case, these inorganic particles form projections of about 0.5 μm or less on the film surface. Even if a heat resistant layer is coated over the film surface having such projections, the projections of about 0.5 μm or less are still retained on the film surface, since the thickness of the heat resistant layer is so small and insufficient to fill vacant spaces among projections.

On the other hand, materials having good thermal conductivity are often included in the synthetic resin film support in order to better the thermal conductivity and to improve the transfer sensitivity of coloring inks when contacted with the thermal head (Japanese Patent Unexamined Publication Nos. 58-55293, 59-162090 and 59-174392). In such a case, projections are also formed on the surface of the synthetic resin film to be contacted with the thermal head.

Such projections damage the surface of the thermal head at the time of thermal transfer recording due to the contact with the thermal head surface under pressure and produce physical wear, and in the worst case, destroy the thermal head. Removal of such a disadvantage has been desired.

SUMMARY OF THE INVENTION

It is an object of this invention to provide a thermal transfer recording sheet having improved take-up characteristics of synthetic resin film and removing the wear of the thermal head.

This invention provides a thermal transfer recording sheet comprising a support, and a thermal transfer coloring ink layer formed on one side of the support, said support containing plate-like or lamellar inorganic fine particles derived from plate-like or lamellar crystal forms as a major component.

DESCRIPTION OF THE PREFERRED EMBODIMENTS

The present inventors have found that the shape of inorganic fine particles has a relation to the damage and wear of the thermal head. The present invention is characterized by including plate-like or lamellar inorganic fine particles derived from plate-like or lamellar crystal forms such as kaolinite, aluminum hydroxide, talc, mica, sericite, and the like in a support the thermal transfer recording sheet as a major component. The support film has good take-up characteristics due to lowering of a friction coefficient of two sides thereof and the wear of the thermal head can be improved by using such a support film.

Such excellent effects cannot be obtained by using prior art inorganic particles such as silicon oxide, calcium carbonate, aluminum oxide, or additives for improving the thermal conductivity of synthetic resin film such as metal powders, e.g. aluminum powder, copper powder, etc., powders of aluminum oxide, magnesium oxide, titanium nitride, calcium carbonate, quartz glass, silicate glass, refractory brick, polyethylene, cellulose, and the like. These inorganic (or organic) fine particles are added to a synthetic resin in an amount of 10 to 90% by volume and kneaded prior to film formation (e.g. Japanese Patent Unexamined Publication No. 58-55293). According to said reference, the film take-up characteristics and the thermal conductivity of the film may be improved, but the wear of the thermal head is not improved. The shape of these inorganic (or organic) particles is ball-like, needles, or these inorganic particles are derived from amorphous materials.

In contrast, the inorganic fine particles used in the present invention have a plate-like or lamellar shape and are derived from plate-like or lamellar crystal forms. The particle size of these plate-like or lamellar particles is preferable when it is as small as possible, for example, 90% by weight or more of these particles having a particle size of 2 μm or less.

The plate-like or lamellar inorganic particles are preferably contained in the support film in an amount of 1 to 50% by weight, more preferably 10 to 30% by weight. When the amount is less than 1% by weight, the take-up characteristics are not improved desirably, whereas when the amount is more than 50% by weight, the transfer . properties of inks at the time of printing is worsened probably due to lowering in the degree of adhesion between the thermal head and the back side of ink film.

The flatness of inorganic particles can also be defined by an aspect ratio (a ratio of average particle size/thickness). The aspect ratio of the inorganic particles is 2.5 or more, preferably 2.5 to 40, more preferably 5 to 20.

The plate-like or lamellar inorganic particles can be formed by grinding kaolinite, aluminum hydroxide, talc, micas such as muscovite, sericite, phlogopite, paragonite, lepidolite, cookeite, etc., by a conventional method.

Kaolinite is a mineral having a plate-like form, for example, hexagonal scales or plates, asymmetric hexagonal plates, rectangular plates, and fine plates, and naturally occurs as kaolin or kaolin clay including impurities.

Aluminum hydroxide is produced industrially and has a plate-like crystal form of various sizes and shapes.

Talc is an acid metasilicate of magnesium containing water and has a plate-like or foliated form.

Muscovite is also called as potassium mica and present as hexagonal plates, leaves or scales.

Sericite is a fine scaly muscovite united in fibrous aggregates and characterized by its silky luster.

Phlogopite is also called as a magnesium mica and present as scales and plates.

These plate-like or lamellar inorganic fine particles can be used alone or as a mixture thereof.

It is possible to use inorganic particles conventionally used such as those having a ball-like or needle-like form or of amorphous in a minor amount together with the plate-like or lamellar inorganic fine particles so long as the wear resistance of thermal head is not damaged. In such a case, the plate-like or lamellar inorganic fine particles are used more than 50% by weight, preferably 60% by weight or more, more preferably 80% by weight or more.

The plate-like or lamellar inorganic fine particles as a major component is kneaded with a synthetic resin by a conventional method, followed by film formation to give a support film of 3 to 15 μm thick.

As the synthetic resin used for the support, there can be used polyesters, polyethylenes, polypropylenes, polyvinyl chlorides, polystyrenes, polycarbonates and polyimides. Considering heat shrinkage, tensile elongation, heat resistance and price, the use of polyester films is preferable.

On one side of the support, a thermal transfer coloring ink layer is formed by a conventional method. As the colorant, there can be used dyes and pigments conventionally used as yellow, magenta, cyan, black and other hues. As a wax, there can be used paraffin wax, carnauba wax, microcrystalline wax, montan wax, low-molecular-weight polyethylene wax, and the like.

As a resin for a binder, there can be used an ethylene-vinyl acetate copolymer, a petroleum resin, a styrene resin, a rosin derivative, etc.

As an oil, there can be used mineral oils and vegetable oils depending on the requirement.

The coloring ink composition comprising these components is coated on the support in 2 to 5 μm thickness.

If necessary, a heat resistant layer may be formed on another side of the support by a conventional method. The formation of the heat resistant layer is disclosed, for example, in Japanese Patent Unexamined Publication Nos. 56-155794, 57-74195, 55-7467, 57-129789, 58-171992, 59-148697, and 59-225994.

The present invention is explained in detail referring to Examples, wherein all percents are by weight unless otherwise specified.

EXAMPLES 1 to 4, COMPARATIVE EXAMPLES1 AND 2

Inorganic fine particles having a particle size of 2 μm or less in a content of 90% or more and a form as shown in Table 1 in an amount of 15% were mixed with polyester resin and formed into films 6.0 μm thick. As the inorganic fine particles, there were used those of kaolinite, aluminum hydroxide, talc, sericite, silicon oxide (comparison) and calcium oxide (comparison). Each film of 6000 m long was taken up with good take-up charac- teristics.

On a back side of each polyester film, a heat resistant layer made from silicone resin with a thickness of 0.2 μm once dried was formed by gravure coating to give a base film. On a front side of the base film, a coloring ink layer was formed 3.0 μm in thickness by hotmelt coating of an ink composition having the following formulation:

| | |
|---|---|
| Ethylene-vinyl acetate resin | 2% |
| Petroleum resin | 5% |
| Paraffin wax (155° F.) | 40% |
| Synthetic carnauba wax | 40% |
| Carbon black | 13% |

A thermal transfer ink film with 148 mm wide was obtained by slitting finish.

Each thermal transfer ink film was subjected to the following tests.

Surface roughness:

The heat resistant layer surface of each base film was measured by using a surface texture measuring instrument Surfcom 304A type (mfd. by Tokyo Seimitsu K.K.) and an average value of roughness (Ra) was calculated and listed in Table 1.

Wear amount of the thermal head surface:

A reel of image receiving paper (TTR-T ®, a trademark, mfd. by Mitsubishi Paper Mills, Ltd.) having a width of 148 mm was produced. The image receiving paper was placed on a thermal transfer ink film so as to face the ink layer opposite to the image receiving paper and subjected to continuous print of checks with 50% in blackness using a facsimile tester (mfd. by Matsushita Denshi Buhin K.K.) under the following print conditions:

| | |
|---|---|
| Head voltage: | 1500 V |
| Head resistance: | 320 Ω |
| Platen pressure: | 20 g/mm |
| Head: Thin film type (mfd. by Matsushita Denshi Buhin K.K.) | |
| Pulse width: | 1.0 ms |

The thermal head was taken off every 1000 m of print length and the surface layer of the heat generation portion of the thermal head was measured by using the surface roughness meter mentioned above at the running direction to measure physical wearing amount (in μm). The measured portion was selected from the upper layer of the heat generator and a portion which shows the maximum wearing portion.

The results are shown in Table 1.

TABLE 1

| Example No. | Inorganic particles | Form of particles | Average roughness Ra (μm) | Wear amount of the thermal head surface (μm) | | | | | |
|---|---|---|---|---|---|---|---|---|---|
| | | | | After 1000 m | After 2000 m | After 3000 m | After 4000 m | After 5000 m | After 10,000 m |
| Example 1 | Kaolinite | Hexagonal plates | 0.16 | 0 | 0 | 0.01 | 0.02 | 0.04 | 0.12 |
| Example 2 | Aluminum hydroxide | Plates | 0.16 | 0 | 0 | — | 0.03 | — | 0.15 |
| Example 3 | Talc | Hexagonal plates | 0.18 | 0 | 0 | — | 0.03 | — | 0.15 |
| Example 4 | Sericite | Hexagonal plates | 0.18 | 0 | 0 | — | 0.04 | — | 0.16 |
| Comparative Example 1 | Silicon oxide | Amorphous | 0.20 | 0.01 | 0.05 | 0.16 | 0.20 | 0.35 | 0.50 |
| Comparative Example 2 | Calcium carbonate | | 0.18 | 0.01 | 0.04 | 0.12 | 0.18 | 0.31 | 0.45 |

As is clear from Table 1, although no large difference in the average roughness (Ra) is seen between Examples 1 to 4 and Comparative Examples 1 and 2, the wearing amount of the thermal head according to Examples 1 to 4 is negligible and shows a long life. In contrast, the wearing amount of the thermal head according to Comparative Examples 1 and 2 is considerable.

Further, in Comparative Examples 1 and 2, a large number of scratches were admitted on the thermal head surface when observed by using a microscope. In contrast, in Examples 1 to 4, almost no scratches were admitted on the thermal head surface even after running 10,000 m and uniform wear on the thermal head surface as a whole was observed.

As explained above, the thermal transfer recording sheet according to the present invention can remarkably improve the wear of the thermal head while maintaining good take-up characteristics of synthetic resin film which is a support of the thermal transfer recording sheet. Thus, the life of the thermal head can be prolonged, which results in making the industrial significance remarkably large.

What is claimed is:

1. A thermal transfer recording sheet comprising a support, and a thermal transfer coloring ink layer formed on one side of the support, said support containing plate-like or lamellar inorganic fine particles derived from plate-like or lamellar crystal forms as a major component.

2. A thermal transfer recording sheet according to claim 1, wherein the inorganic fine particles are those of kaolinite, aluminum hydroxide, talc, sericite, micas, or a mixture thereof.

3. A thermal transfer recording sheet according to claim, 1, wherein the support is a synthetic resin film.

4. A thermal transfer recording sheet according to claim 3, wherein the synthetic resin film is a polyester film.

5. A thermal transfer recording sheet according to claim 1, wherein the inorganic fine particles have a particle size of 2 μm or less in a content of 90% by weight or more.

6. A thermal transfer recording sheet according to claim 1, wherein the inorganic fine particles are contained in a synthetic resin film in an amount of 10 to 30% by weight.

7. A thermal transfer recording sheet according to claim 1, wherein the support has a heat resistant layer on another side thereof.

* * * * *